US005701861A

United States Patent [19]

Hegemier et al.

[11] Patent Number: 5,701,861

[45] Date of Patent: Dec. 30, 1997

[54] CYLINDER WITH HYBRID BORE SURFACE

[75] Inventors: Timothy Alan Hegemier, Eaton, Ohio; John Dudley Binford, Richmond, Ind.

[73] Assignee: Dana Corporation, Toledo, Ohio

[21] Appl. No.: 278,739

[22] Filed: Jul. 22, 1994

[51] Int. Cl.[6] ..... C23F 17/00

[52] U.S. Cl. ..... 123/193.2

[58] Field of Search ..... 123/193.2, 193.1, 123/193.3, 668; 29/888.06, 888.061

[56] References Cited

U.S. PATENT DOCUMENTS

| | | | |
|---|---|---|---|
| 2,809,873 | 10/1957 | Cavileer . | |
| 3,620,137 | 11/1971 | Prasse . | |
| 3,657,078 | 4/1972 | Schweikher . | |
| 3,749,072 | 7/1973 | Schweikher . | |
| 3,903,951 | 9/1975 | Kaneko et al. | 123/193.2 |
| 3,932,228 | 1/1976 | Sugiyama et al. | 123/193.2 |
| 4,044,217 | 8/1977 | Otsuki et al. | 123/193.2 |
| 4,196,547 | 4/1980 | Keske . | |
| 5,191,864 | 3/1993 | Santi | 123/193.2 |

FOREIGN PATENT DOCUMENTS

| | | |
|---|---|---|
| 0559328 | 9/1993 | European Pat. Off. . |
| 0586791 | 12/1993 | European Pat. Off. . |
| A3735266 | 4/1989 | Germany . |
| 57194844 | 5/1981 | Japan . |
| 2088260 | 6/1982 | United Kingdom . |

*Primary Examiner*—Marguerite Macy

*Attorney, Agent, or Firm*—Rader, Fishman & Grauer, PLLC

[57] ABSTRACT

An internal combustion engine cylinder bore has a hybrid surface to optimize both wear of the cylinder and oil consumption of the engine. The surface has a coarsely honed surface over at least one of a top portion and a bottom portion of the bore surface. A mid-portion disposed between the top portion and the bottom portion has a finely honed surface.

4 Claims, 1 Drawing Sheet

CYLINDER WITH HYBRID BORE SURFACE

FIELD OF THE INVENTION

The present invention relates to improvements in surfaces of internal combustion engine cylinder bores.

BACKGROUND OF THE INVENTION

A surface of an internal combustion engine cylinder bore must satisfy the potentially competing goals of minimizing both cylinder wear and lubrication oil consumption. Providing a surface which channels a plentiful supply of lubrication oil along the cylinder bore surface as a means of minimizing wear may result in higher than desired consumption of lubrication oil. A perfectly smooth cylinder bore surface providing a minimum clearance fit with the piston rings would likely minimize lubrication oil consumption by preventing its passage beyond piston rings, but may result in increased wear of the cylinder and piston rings due to lack of lubrication.

Two surface characteristics, porosity and roughness, have been the principal variables controlled in attempts to achieve an optimal hybrid surface that balances wear with oil consumption objectives. In one approach, bands of material having variant porosity characteristics are deposited in the cylinder bore at predetermined axial locations. After the deposition of various metals, the cylinder is honed, providing the bore with a generally common surface roughness with locally varying porosities.

In another approach, the entire cylinder bore is plated with chromium, and is then honed to provide a relatively smooth surface therein. The ends of the cylinder bore surface are then masked off and the exposed center area subjected to a roughening treatment such as grit blasting. The result is a hybrid cylinder bore with a rough surface in the center of the bore and relatively smooth surfaces at the top and bottom of the bore. Yet, such masking operations are very time consuming and expensive to execute in high volume production.

Therefore, known methods of providing hybrid cylinder bore surfaces do not provide a hybrid surface well suited for optimizing wear and oil consumption over the entire range of piston travel which is cost effective to produce.

SUMMARY OF THE INVENTION

An internal combustion engine cylinder bore surface comprises at least one of a top portion and a bottom portion of the bore surface being coarsely honed. A mid-portion disposed between the top portion and the bottom portion has a finely honed surface.

Also disclosed is a method of finishing an internal combustion engine cylinder bore surface comprising the steps of providing a cylinder bore in a piece of metal and providing at least one honing tool with a plurality of selectively engagable stones. The method also includes establishing a predetermined rotational speed between the honing tool and the metal, and inserting the honing tool into the bore. The honing stones are biased radially outward to engage them with the bore surface. Relative axial oscillation between the honing tool and the metal with the bore is established. The bore surface may thereby be roughly honed at both a top portion and a bottom portion with a smoothly honed surface at a mid portion disposed therebetween.

The features of the present invention can be best understood from the following specification and drawings of which the following is a brief description.

DESCRIPTION OF A PREFERRED EMBODIMENT

Figure 1:
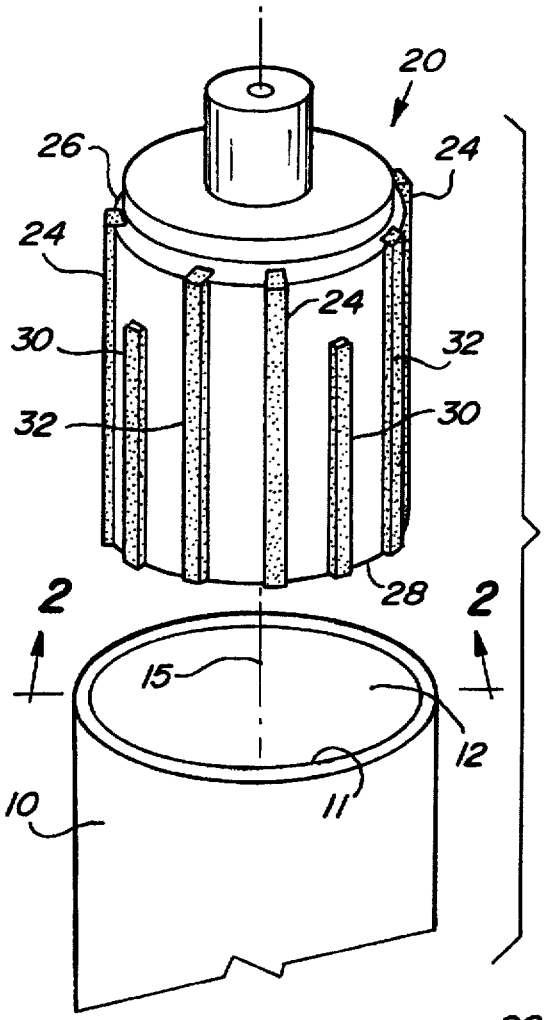
FIG. 1 is a perspective view of a honing tool used for the present invention aligned with a cylinder liner.
Figure 2:
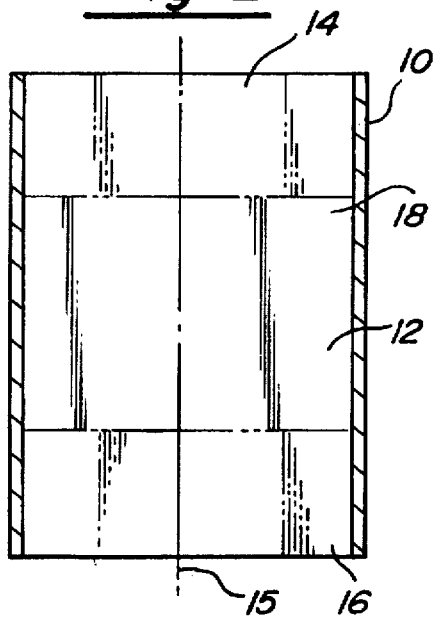
FIG. 2 is a cross-sectional view of a cylinder liner incorporating the present invention.

A metal cylinder liner 10, illustrated in FIGS. 1 and 2, for an internal combustion engine (not shown), defines a cylinder bore 11 with a surface 12. A top portion 14 of the cylinder bore surface 12 is contacted by piston rings (not shown) at a top portion of the piston stroke, top dead center, where the piston (not shown) reverses direction on a central axis 15. The top portion 14 of the cylinder bore surface 12 is a coarsely honed surface having a cross hatched finish characteristic of honing. A bottom portion 16 of the cylinder bore surface 12 is contacted by the piston rings at a bottom portion of the piston stroke where the piston reverses direction and is also a coarsely honed surface. The peaks of the coarsely honed portions 14, 16 are flattened, or plateaued. A mid-portion 18 of the surface 12, disposed between the top portion 14 and the bottom portion 16, has a relatively smoothly, or finely honed surface. The coarsely honed surfaces of the top and bottom portions 14, 16 provide increased amounts of lubricants in these areas where the velocity of the piston and the associated piston rings (not shown) is zero or near zero. The resultant deep valleys of the coarsely honed surfaces allow for some lubricant to be retained therein and additionally give resultant wear debris a place to go, reducing further wear. In the smoothly honed mid-portion 18, where the ring velocity across the surface 12 is relatively high, hydrodynamic lubrication exists. Metal-to-metal contact is limited to asperity contact, and therefore a very smooth (plateau honed) surface in this center area offers reductions in asperity contact, wear, and oil consumption. The combination of the coarsely honed surfaces 14, 16 at the ends of the liner 10 with the smooth mid-portion 18 provides a hybrid surface 12 which optimizes engine performance in all areas.

Exemplary values in micrometers for the coarse and smooth surfaces are as follows:

| | Coarse | Smooth |
|---|---|---|
| $R_{pk}$ | .7 | .15 |
| $R_k$ | 2.0 | .4 |
| $R_{vk}$ | 5.0 | 1.3 |

$R_{pk}$, $R_{vk}$, and $R_k$ are established according to DIN4776, a surface measure standard well known to those skilled in the art of surface finish measurement. $R_{pk}$ is a roughness measurement of peaks of the surface, $R_{vk}$ is a roughness measurement of valleys of the surface, and $R_k$ is a roughness measurement of a bearing surface.

Figure 3:
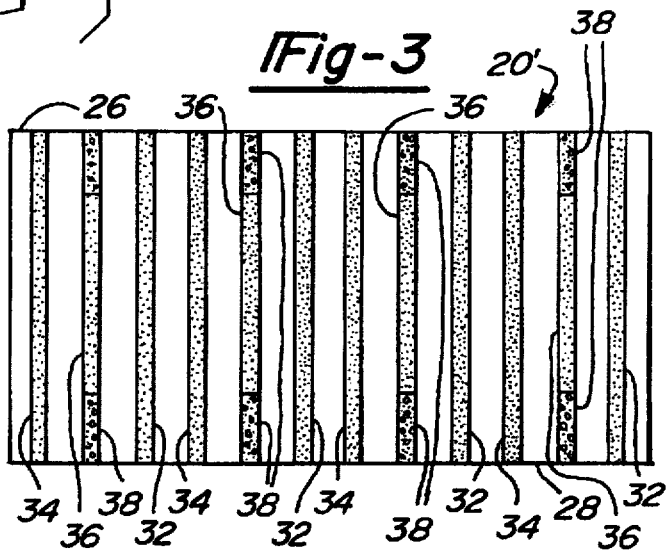
FIG. 3 is a diagrammatic representation of the honing tool with an alternative combination of stones projected onto a flat surface.
Figure 4:
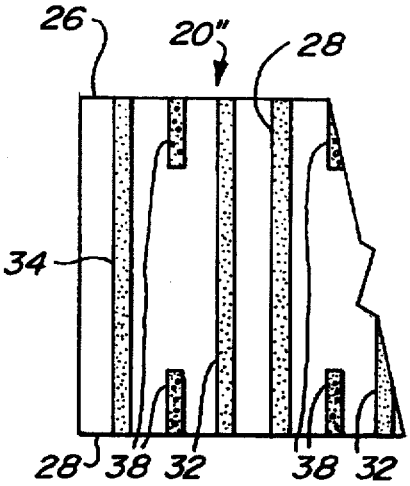
FIG. 4 is a diagrammatic representation of a portion of the honing tool with a second alternative combination of stones projected onto a flat surface.

The hybrid bore surface 12 is achieved using a compound honing tool 20 configured as illustrated in FIGS. 2–4. The compound honing tool 20 is functionally equivalent to three different honing tools in one. It has three different types of honing stones which are selectively actuable. The stones are the cutting elements used for abrading material from the work surface of the cylinder bore 11. A total of twelve stones, four of each type, are evenly spaced around a perimeter of the tool 20. The stones are distributed first, second, third, first, second, third, and so on, so that identical types of stones are uniformly spaced from one other. The order of the stone distribution is not particularly important, but it is important that identical stones be evenly spaced from each other to provide an even distribution of reaction forces against the honing tool 12.

The honing tool 20 is adapted to selectively apply all of one of the first, second, and third types of stones. The various stones are biased radially inward by springs (not shown). Four identical stones, the first type of stones for example, are selectively biased radially outward simultaneously by the application of pressure to the honing tool 20 through a fluid circuit (not shown). In this way, all four of the like stones can be applied while the other stones are held in a withdrawn position by the springs. By selective application of the stones of varying coarseness and lengths, the desired honing pattern on the cylinder bore surface 12 is achieved.

A first exemplary set of stones is illustrated in FIG. 1. A coarse stone 24 extends from a first edge 26 of the honing tool 20 to a second edge 28 of the honing tool 20. Adjacent and parallel to the rough stone 24, a medium stone 30 extends across a center or mid-portion of the tool 20, spaced from both the first edge 26 and the second edge 28. Adjacent the medium stone 30 is a smooth or fine stone 32, providing the third of the three stone set. The smooth stone 32 extends from the first edge 26 of the honing tool 20 to the second edge 28 of the honing tool 20.

Honing tools are typically oscillated in an axial direction in and out of the bore while rotating to achieve the characteristic cross hatching pattern associated with honing. With the present disclosure, the axial stroke would be limited to preserve the top portion 14 and bottom portion 16 of the cylinder bore surface 12 in a coarser condition than the mid-portion 18 of the surface. Additionally, before the tool 20 is withdrawn from the cylinder bore, pressure within the honing tool 20 is relieved to allow the stones to retract into the honing tool 20, thereby not impinging on the cylinder bore surface 12 during withdrawal. It is appreciated, of course, that the cylinder liner 10 could also be rotated and oscillated about a stationary honing tool to achieve the desired surface finish, and that the rotating and oscillating functions can be separated between the honing tool 20 and the liner 10.

In a honing tool 20' with an alternative combination of stones, as illustrated in FIG. 3, a first of the three stones in the set is a medium stone 34 extending from the first edge 26 to the second edge 28 of the honing tool 20'. The second stone is actually a combination of smooth and coarse stones. A central smooth stone 36 extends across the mid-portion of the tool 20', spaced from both the first edge 26 and the second edge 28 of the honing tool. Two relatively short coarse stones 38 extend from an outer edge of the smooth stone 36 to either the first edge 26 or the second edge 28 of the honing tool 20. The third stone is a smooth stone 32 extending from the first edge 26 to the second edge 28 of the honing tool 20'.

In yet another alternative embodiment of the honing tool 20" illustrated in FIG. 4, the first stone is a medium stone 34 extending from the first edge 26 of the honing tool 28 to the second edge 28 of the honing tool 20". The second stone is a pair of short coarse stones 38 disposed at the first edge 26 and the second edge 28 of the honing tool 20" with a gap therebetween. The third stone is the smooth stone 32.

Each of the alternative stone arrangements is configured to provide essentially the same relatively smooth mid-portion 18 and top and bottom portions 14, 16 having relatively deep honing grooves. Each of the alternative stone arrangements presented here follows an application of a rough stone against the surface with application of a smooth stone. This flattens or plateaus the peaks of the rough portions while leaving the deeper valleys intact, providing the sought after lubrication retention and communication characteristics in these portions 14, 16.

By employing the described honing tool 20, 20', 20" with the specified stone arrangements, the desired hybrid surface can be obtained using a single tool in a single operation, resultantly providing a surface which optimizes both the wear characteristics and oil consumption characteristics of the cylinder bore. The resultant cross hatched honing pattern is distinctive from a pitted surface characterizing porous surfaces. While porous surfaces may be effective at retaining lubricating oil, they are less effective at transferring oil across the surface than coarsely honed surfaces with their characteristic cross hatched grooves.

Preferred embodiments have been disclosed. A worker of ordinary skill in the art would realize, however, that certain modifications would come within the teaching of this invention. For example, it may be desirable to have Just the top portion 14 of the surface 12 with a coarse surface. Likewise, it may be preferred to employ two separate honing tools, with a first being a compound honing tool with only eight stones, or two stones per set. A second honing tool would have a type of stone in it for serving as a follow up finish to the finish provided by the compound honing tool. This would allow the use of commercially available honing tools to minimize tooling expenses. The following claims should be studied in order to determine the true scope and content of the invention.

We claim:

1. An internal combustion engine cylinder bore surface comprising:

a top portion and a bottom portion of the cylinder bore surface both being coarsely honed; and a mid-portion disposed between the top portion and the bottom portion, said mid-portion being finely honed.

2. An internal combustion engine cylinder bore surface as claimed in claim 1, wherein one of the top and the bottom portion is less coarsely honed than the other portion.

3. An engine cylinder bore surface as claimed in claim 1, wherein peaks of the coarsely honed portions of the surface are plateaued.

4. An internal combustion engine cylinder bore surface comprising:

a top portion of the bore surface being coarsely honed with peaks thereof being finely honed;

a bottom portion of the bore surface being coarsely honed with peaks thereof being finely honed; and a mid-portion disposed between the top portion and the bottom portion being finely honed.

* * * * *